US007494432B2

(12) United States Patent
Flanigan

(10) Patent No.: US 7,494,432 B2
(45) Date of Patent: Feb. 24, 2009

(54) APPARATUS FOR CALCULATING DISTANCE OF BALL PLACED IN MOTION BY MEASURING FORCE EXERTED UPON IT AND LAUNCH ANGLE

(75) Inventor: George R. Flanigan, Hanover Park, IL (US)

(73) Assignee: George Flanigan, Mt. Prospect, IL (US)

( * ) Notice: Subject to any disclaimer, the term of this patent is extended or adjusted under 35 U.S.C. 154(b) by 0 days.

(21) Appl. No.: 11/397,767

(22) Filed: Apr. 4, 2006

(65) Prior Publication Data

US 2006/0223657 A1 Oct. 5, 2006

Related U.S. Application Data

(60) Provisional application No. 60/668,375, filed on Apr. 5, 2005.

(51) Int. Cl.
*A63B 69/00* (2006.01)
*A63B 69/40* (2006.01)

(52) U.S. Cl. ..... 473/426; 473/422; 473/451; 473/430

(58) Field of Classification Search ..... 473/421, 473/422, 426, 430, 197, 423, 429, 143, 140, 473/145; 273/410; 256/24, 25, 26
See application file for complete search history.

(56) References Cited

U.S. PATENT DOCUMENTS 3,406,571 A * 10/1968 Hackey ..... 473/141
3,642,282 A * 2/1972 Frischman ..... 473/478
4,735,413 A * 4/1988 Yamanouchi et al. ..... 473/426
5,056,790 A * 10/1991 Russell ..... 473/143
5,178,393 A * 1/1993 Dennesen ..... 473/140
5,332,225 A * 7/1994 Ura ..... 473/223
5,419,550 A * 5/1995 Blom ..... 473/426
5,454,561 A * 10/1995 Smith ..... 473/429
5,539,957 A * 7/1996 Schmidt ..... 473/478
5,586,940 A * 12/1996 Dosch et al. ..... 473/140
5,605,326 A * 2/1997 Spear, Jr. ..... 473/422
5,681,045 A * 10/1997 Liao ..... 473/478
5,776,017 A * 7/1998 Brawn ..... 473/426
5,997,405 A * 12/1999 Russell et al. ..... 473/140
6,146,283 A * 11/2000 Ferguson, III ..... 473/145
6,257,989 B1 * 7/2001 Tortola et al. ..... 473/140
6,371,873 B1 * 4/2002 Wang ..... 473/478
6,551,194 B2 * 4/2003 Hammerquist ..... 473/145
2006/0223657 A1 * 10/2006 Flanigan ..... 473/423

* cited by examiner

*Primary Examiner*—Mitra Aryanpour
(74) *Attorney, Agent, or Firm*—Randall Erickson; Randall T. Erickson

(57) ABSTRACT

The present invention provides an apparatus for calculating the distance of a ball placed into motion comprising, a means for positioning a ball at a desired height for striking, a means for measuring force exerted upon the ball when struck, a means for measuring launch angle relative to a horizontal playing field which a ball travels upon impact, a means for calculating distance the ball would travel if not restricted using the measured force and launch angle, and a means to display the calculated distance.

18 Claims, 3 Drawing Sheets

APPARATUS FOR CALCULATING DISTANCE OF BALL PLACED IN MOTION BY MEASURING FORCE EXERTED UPON IT AND LAUNCH ANGLE

PRIORITY

This U.S. Utility Patent Application claims the benefit of an earlier filed U.S. Provisional Application Ser. No. 60/668,375 filed on Apr. 5, 2005.

FIELD OF THE INVENTION

The present invention relates to a portable apparatus which can calculate the actual distance a ball would travel upon being struck by a tennis racket, baseball bat, golf club and the like by measuring the force of impact upon the ball and angle of launch.

BACKGROUND OF THE INVENTION

Many practice devices are currently available on the market such as batting tees and batting cages to improve a batter's swing. Some are permanently affixed to the ground, and others are portable. While they are useful in containing a ball which is struck by a baseball bat, they cannot help the batter determine the actual distance the ball would have traveled if the path of the ball was not restricted in any way. The distance a ball travels is of utmost importance in the game of baseball. The further the ball travels, the more likely the batter can run safely to a base without being tagged out.

Similarly, in golf controlling the distance of the golf ball is critical. The more accurately and further a golfer can place the ball, the more likely he will be under par.

SUMMARY OF THE INVENTION

The present invention provides an apparatus for calculating the distance of a ball placed into motion comprising, a means for positioning a ball at a desired height for striking, a means for measuring force exerted upon the ball when struck, a means for measuring launch angle relative to a horizontal playing field which a ball travels upon impact, a means for calculating distance the ball would travel if not restricted using the measured force and launch angle, and a means to display the calculated distance.

DETAILED DESCRIPTION OF THE INVENTION

Figure 1:
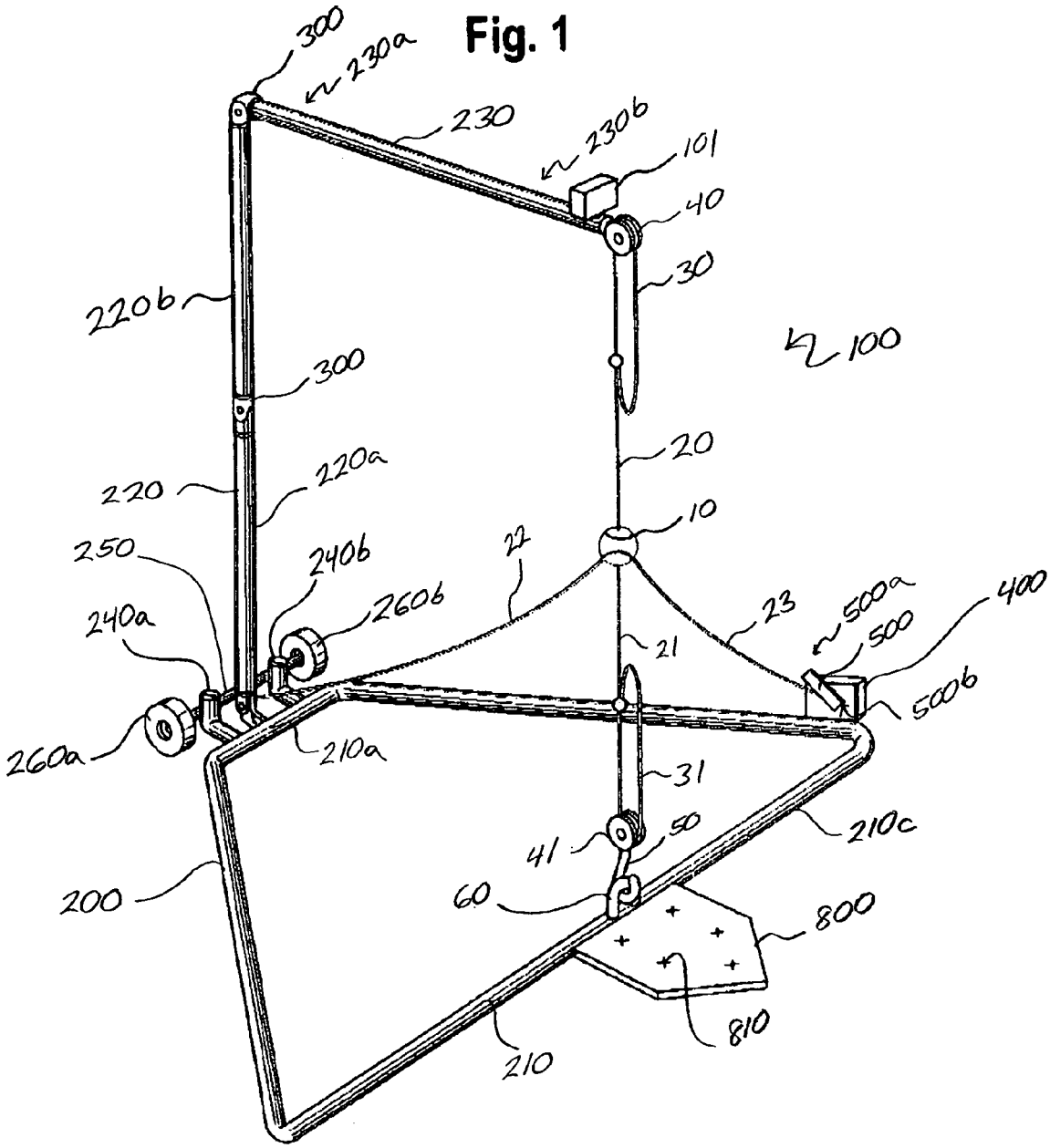
FIG. 1 is a perspective view of the batting practice apparatus.

Turning now to the drawings, and more particularly FIG. 1, what is shown is a batting practice apparatus 100 comprising a collapsible frame 200. Collapsible frame 200 can be constructed from solid or hollow tubular plastic, steel, aluminum or other lightweight materials. Collapsible frame 200 is comprised of a base frame 210, vertical stand 220 and arm 230. In one embodiment, shown in FIG. 1 base frame 210 is trapezoidal having four sections 210*a,b,c*, and *d*. However it is contemplated that base frame 210 can be formed in a variety of other shapes such as, for example but not limited thereto, circular, square, rectangular, triangular or virtually any shape.

Secured to section 210*a* of base frame 210 are axel holders 240*a* and *b* through which axel rod 250 extends. Wheels 260*a* and 260*b* are attached to either end of axel rod 250.

In one embodiment, vertical stand 220 is constructed from at least two separate sections 220*a* and *b* which are connected to one another by connector 300. However, it is also contemplated that vertical stand 220 can be constructed from one contiguous section. The proximal region 230*a* of arm 230 is removably affixed to vertical stand 220 by yet another connector 300. Connector 300 can be quickly loosened to disconnect arm 230 from vertical stand 220, as well as disconnect the separate sections of vertical stand 220 from each other for compact storage or transport.

Ball 10 is secured to frame 200 by a means for positioning the ball at a desired height. Ball 10 can be a baseball, softball, golf ball, soccer ball, football and the like. In one embodiment, as shown in FIG. 1, ball 10 is tethered to cables 20 and 21 along its vertical axis which are attached to cable loops 30 and 31. Cable loops 30 and 31 run around pulleys 40 and 41. Pulley 40 is removably attached by hook 50 to eyelet 60. Eyelet 60 is affixed to base frame 210 at section 210*c*. Pulley 41 is either removably or permanently attached to distal region 230*b* of arm 230 of collapsible frame 200. When loops 30 and 31 are both rotated simultaneously clockwise or counterclockwise, the height of the ball can be lowered or raised in relation to ground upon which base frame 210 rests. Tether 22 extends from ball 10 to vertical stand 220 and prevents it from ricocheting back towards a batter when hit.

In another embodiment, ball 10 can be positioned upon a batting tee which can be adjusted to a desired height.

Tether 23 extends from ball 10 to the distal end 500*a* of detector arm 500, the proximal end 500*b* of which is connected to a force/angle meter 400. In one embodiment, force/angle meter 400 is comprised of two individual components, a force meter and an angle meter. However, it is contemplated that both the force meter and angle meter can be integrated together to form a single unit. Several force meters which are suitable for use with the present invention are currently available on the market. Such force meters include, for example but not limited thereto: Model Nos. EX475040 and EX475044 manufactured by Extech; Model Nos. MG, FGE/FGV, DPS, Z2, FGE-HX/FGV-FX DPSH, BGI, CG, MG and MK by Electromatic. Several angle meters which are suitable for use with the present invention are currently available on the market. Such angle meters include, for example but not limited thereto: Model No. Pro 3600 manufactured by Macklanburg; AccuStar.®. Electronic Clinometer manufactured by Schaevitz Sensors.

When the ball is struck by a baseball, tether 23 pulls detector arm up or down and away from the meter 400. The force exerted upon ball 10 is detected and measured by force meter and the angle is detected and measured by angle meter. The angle and force measurements are then relayed to a microprocessor which can calculate the actual distance ball 10 would have traveled if not restricted by tethers. The calculations performed by the microprocessor will take into account the weight of the ball being used as well as the force of impact and launch angle. The microprocessor can also calculate the average force of impact, launch angle and distance for a single batter or a multiplicity of batters. The calculated distance, or any other statistic, can then be relayed from the microprocessor and displayed upon display screen 101. In one embodiment, the display screen is a liquid crystal display. In one embodiment, a multiplicity of display screens are present so that if more than one person is practicing, then each individual's score can be displayed.

A batter can find an optimum batting stance to achieve maximum or desired distance when batting a ball. The batter can remember the optimum batting stance in relation to home plate using practice home plate 800 which has marking 810 thereon.

Figure 2:
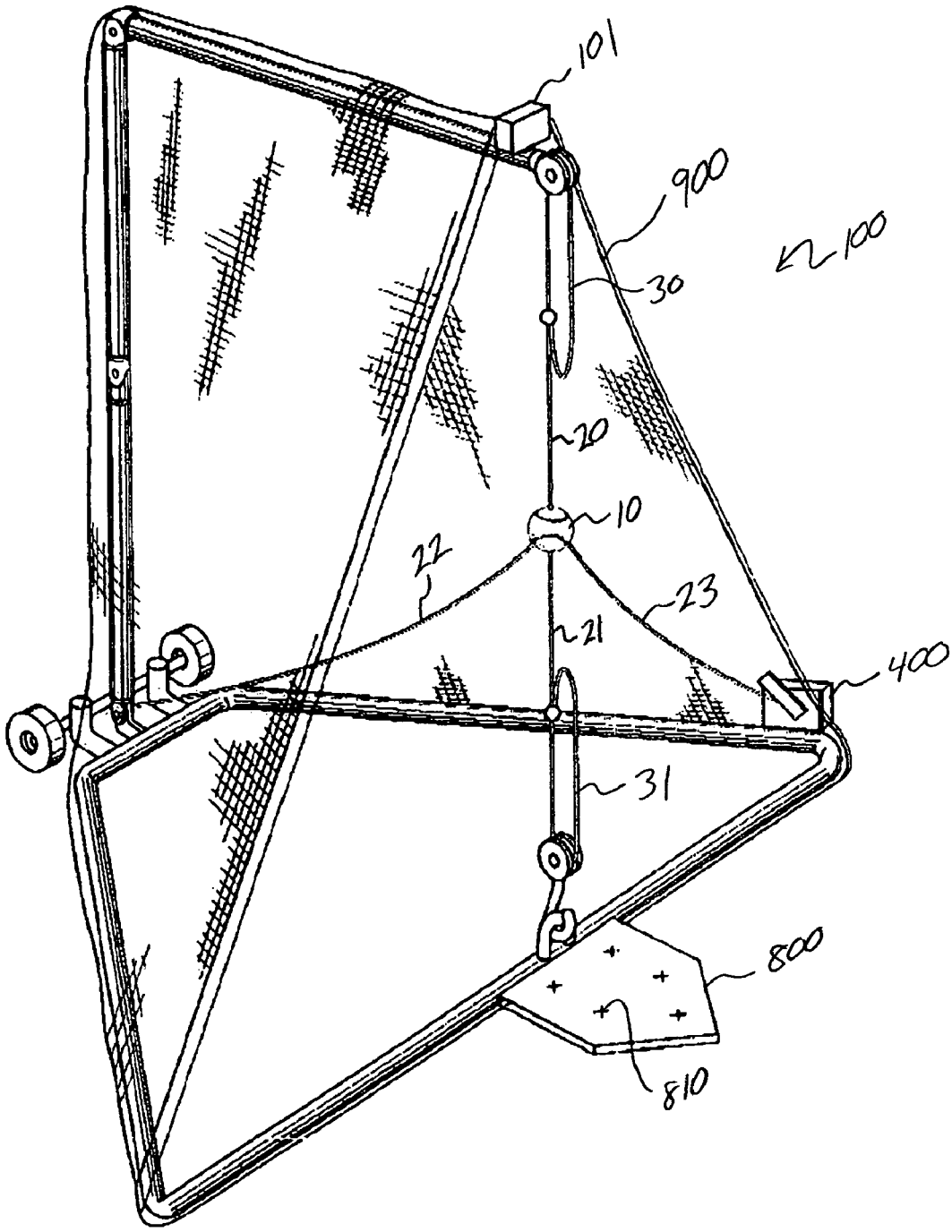
FIG. 2 is a perspective view of the batting practice apparatus with netting.

FIG. 2 shows another embodiment of the batting practice apparatus 100 with safety netting 900 which traps ball 10 in case the tethers attached to it break.

Figure 3:
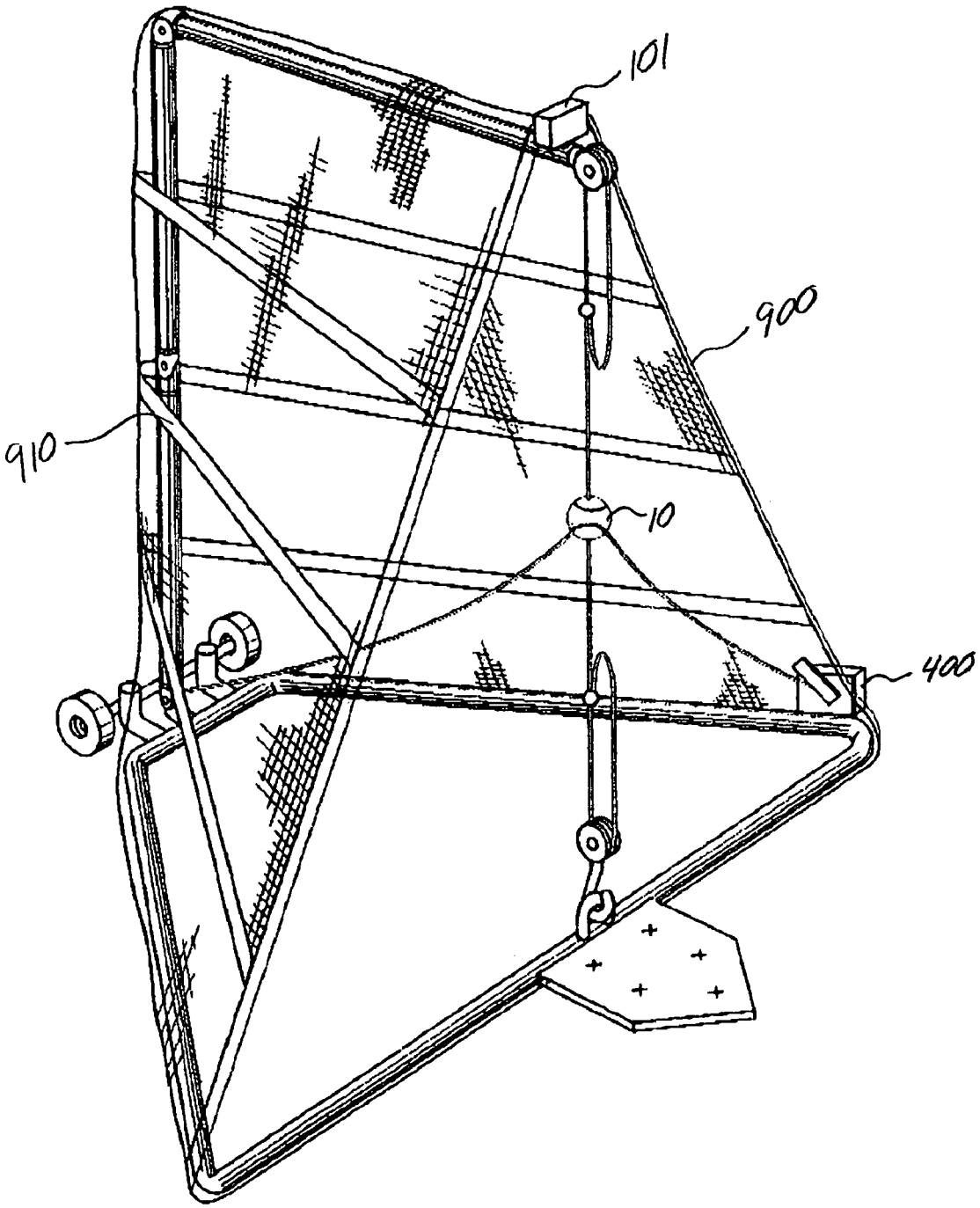
FIG. 3 is a perspective view of the batting practice device with launch angle sensors.

FIG. 3 shows stripes 910 on netting 900 running horizontally. Several stripes 910 are affixed to netting 900 and each stripe signals to the batter the angle which the ball is traveling relative to the ground. The angle helps the athlete better estimate the distance the ball will travel. In one embodiment, each stripe is affixed to a tether which then connects to a force meter. When the stripe is contacted by a untethered ball, the angle measure is relayed to a microprocessor along with the force of impact. These measurements taken along with the weight of the ball will be used to calculate the distance the ball would travel if unrestricted in motion.

In use, a batter can adjust the height of the ball by rotating, either clockwise or counterclockwise, adjusting loops 30 and 31. The batter then strikes ball 10 with a baseball bat with a particular force causing the ball to travel forward at a certain angle known as the launch angle. Tether 22 extending from ball 10 to vertical stand 220 prevents ball 10, now traveling forward and away from the batter, from ricocheting back towards a batter.

As the ball moves forward, tether 23 pulls on the distal end 500*a* of detector arm 500. Tether 23 also pulls detector arm 500 up or down. The force exerted upon ball 10 is detected and measured by force meter and the angle is detected and measured by angle meter. The angle and force measurements are then relayed to a microprocessor which calculates the actual distance ball 10 would have traveled if not restricted by tethers. The calculated distance is then relayed from the microprocessor and displayed upon display screen 101.

The batter can find an optimum batting stance to achieve maximum or desired distance when batting a ball by choosing from several positions shown as markings 810 around the practice home plate 800.

While the examples show the device of the present invention in use for batting practice, this device can be utilized for various other sports such as golf, cricket, tennis, football, soccer or just about any other sport which uses a ball.

What is claimed is:

1. An apparatus for calculating the distance of a ball placed into motion comprising:

a means for positioning a ball at a desired height for striking;

a means for directly measuring force exerted upon the ball when struck;

an angle meter offset to the side of said means for positioning and having a detector arm tethered to said ball, said detector arm pulled by said ball during flight of said ball, said angle meter responsive to the angle of flight of said ball after being struck, by movement of said detector arm, said angle meter located to measure trajectory of said ball in both vertical and horizontal planes; and a means for calculating distance the ball would travel if not restricted using the measured force and angle of flight of said ball.

2. The apparatus of claim 1, wherein the ball positioning means comprises at least one loop and pulley tethered to the ball.

3. The apparatus of claim 1, wherein the force measuring means is a digital force gauge.

4. The apparatus in claim 1, wherein the angle meter is an electronic incline meter.

5. The apparatus of claim 1, wherein the distance calculating means is a microprocessor.

6. The apparatus of claim 1, further comprising a means to display the calculated distance.

7. The apparatus of claim 6, wherein the means to display the calculated distances is a liquid crystal display.

8. The apparatus according to claim 1, wherein said means for positioning the ball comprises:

a base frame, a vertical stand supported on said base frame, and an arm extending from said vertical stand.

9. The apparatus of claim 8, wherein said vertical stand is articulated into at least two pieces of approximately equal length.

10. the apparatus of claim 8, wherein a safety net is attached to said base frame, said vertical stand, and said arm.

11. The apparatus of claim 10, wherein said apparatus is self-standing and portable.

12. The apparatus of claim 8, further comprising a plate operatively connected to said base frame from substantially beneath said ball and extending horizontally outwardly therefrom.

13. An apparatus for calculating the distance of a ball upon impact comprising:

a means for positioning a ball at a desired height for striking;

a force gauge which directly measures the force exerted upon the ball;

an angle meter offset to the side of said means for positioning and having a detector arm, said detector arm pulled by said ball during flight of said ball, said angle meter responsive to the angle of flight of said ball after being struck, by movement of said detector arm;

a microprocessor signal-connected to said force gauge and to said angle meter, which calculates the distance the ball will travel based upon the force of impact and angle of flight of said ball;

a first tether extending from said ball to a distal end of said detector arm, a proximal end of said detector arm of which is connected to said angle meter; and a second tether extending from said ball to said means for positioning said ball, preventing said ball from ricocheting back towards a batter when hit, wherein as said ball moves forward, said first tether pulls on the distal end of said detector arm, and wherein said first tether also pulls said detector arm up or down.

14. The apparatus according to claim 13, wherein said means for positioning the ball comprises:

a base frame, a vertical stand supported on said base frame, and an arm extending from said vertical stand.

15. The apparatus of claim 14, wherein said vertical stand is articulated into at least two pieces of approximately equal length.

16. The apparatus of claim 14, wherein a safety net is attached to said base frame, said vertical stand, and said arm.

17. The apparatus of claim 13, wherein said apparatus is self-standing and portable.

18. The apparatus of claim 13, further comprising a plate connected to said means for positioning the ball from substantially beneath said ball and extending horizontally outwardly therefrom.

* * * * *